US010302306B2

(12) United States Patent
Bach

(10) Patent No.: US 10,302,306 B2
(45) Date of Patent: May 28, 2019

(54) COOKING APPLIANCE AND KNOB ASSEMBLY

(71) Applicant: Haier US Appliance Solutions, Inc., Wilmington, DE (US)

(72) Inventor: James Carter Bach, Westfield, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 126 days.

(21) Appl. No.: 15/487,475

(22) Filed: Apr. 14, 2017

(65) Prior Publication Data

US 2018/0299135 A1 Oct. 18, 2018

(51) Int. Cl.

| | |
|---|---|
| ***F24C 3/12*** | (2006.01) |
| ***F24C 7/08*** | (2006.01) |
| ***G05G 1/08*** | (2006.01) |
| ***G05G 1/12*** | (2006.01) |
| ***G05G 25/04*** | (2006.01) |

(52) U.S. Cl.

CPC ..... *F24C 7/081* (2013.01); *F24C 3/122* (2013.01); *G05G 1/12* (2013.01); *G05G 25/04* (2013.01); *G05G 1/08* (2013.01); *G05G 1/082* (2013.01)

(58) Field of Classification Search

None

See application file for complete search history.

(56) References Cited

U.S. PATENT DOCUMENTS 3,711,672 A * 1/1973 Moreland, II ..... F24C 7/083 126/211
4,158,216 A * 6/1979 Bigelow ..... H03K 17/98 200/600
4,233,593 A * 11/1980 Bigelow ..... G06F 3/03547 340/870.37
5,646,587 A * 7/1997 Miyazawa ..... H03K 17/97 335/205

(Continued)

FOREIGN PATENT DOCUMENTS

CN 101741367 A 6/2010
CN 204786647 U 11/2015

(Continued)

OTHER PUBLICATIONS

Translation of JP 2007-109649, attached as "JP2007109649A.pdf" (Year: 2007).*

*Primary Examiner* — Avinash A Savani
*Assistant Examiner* — Martha M Becton
(74) *Attorney, Agent, or Firm* — Dority & Manning, P.A.

(57) ABSTRACT

A cooking appliance and knob assembly are generally provided herein. The knob assembly may include a control panel, a control knob, an attractor plate, and an analog position sensor. The control knob may be selectively disposed on the control panel at a planar outer surface. The control knob may include a knob body and a first magnetic assembly rotatable about a central axis extending perpendicular to the control panel. The attractor plate may be mounted behind the control panel about the central axis. The attractor plate may include a second magnetic assembly in (Continued)

selective magnetic engagement with the first magnetic assembly. The analog position sensor may be mounted to the attractor plate to detect an angular position of the attractor plate about the central axis.

20 Claims, 9 Drawing Sheets

(56) References Cited

U.S. PATENT DOCUMENTS

| | | | | |
|---|---|---|---|---|
| 5,920,131 | A | 7/1999 | Platt et al. | |
| 6,188,332 | B1 | 2/2001 | Scarlata | |
| 6,498,326 | B1 | 12/2002 | Knappe | |
| 6,812,435 | B2 * | 11/2004 | Schilling | F24C 7/083 200/18 |
| 6,838,785 | B2 | 1/2005 | Schilling | |
| 7,038,667 | B1 | 5/2006 | Vassallo et al. | |
| 7,642,673 | B2 | 1/2010 | Baier | |
| 7,642,886 | B2 | 1/2010 | Boss | |
| 8,100,891 | B2 * | 1/2012 | Baur | A61B 17/1626 173/213 |
| 8,106,733 | B2 * | 1/2012 | Nakasuji | H01H 36/0066 219/457.1 |
| 8,217,742 | B2 | 7/2012 | Trudeau et al. | |
| 8,330,713 | B2 * | 12/2012 | Stelandre | B60K 35/00 178/18.01 |
| 8,440,945 | B2 | 5/2013 | Blumenthal et al. | |
| 8,662,071 | B2 | 3/2014 | Simmons | |
| 9,093,237 | B2 * | 7/2015 | Bondar | F24C 7/083 |
| 2005/0224066 | A1 * | 10/2005 | Li | F24C 3/126 126/39 BA |
| 2007/0181410 | A1 * | 8/2007 | Baier | F24C 7/082 200/17 R |
| 2009/0125024 | A1 * | 5/2009 | Baur | A61B 17/1626 606/42 |
| 2010/0253653 | A1 | 10/2010 | Stambaugh et al. | |
| 2013/0343588 | A1 | 12/2013 | Karunasiri | |

FOREIGN PATENT DOCUMENTS

| | | | | |
|---|---|---|---|---|
| CN | 103794397 | B | 12/2015 | |
| DE | 19859105 | A1 | 6/2000 | |
| DE | 10035592 | A1 | 1/2002 | |
| DE | 10229629 | A1 | 1/2004 | |
| DE | 102004013947 | B3 | 12/2005 | |
| DE | 102010039559 | A1 | 2/2012 | |
| EP | 0797227 | A2 | 9/1997 | |
| JP | 2007109649 | A * | 4/2007 | F24C 7/082 |
| WO | WO2012118455 | A2 | 9/2012 | |
| WO | WO2013122555 | A2 | 8/2013 | |

* cited by examiner

COOKING APPLIANCE AND KNOB ASSEMBLY

FIELD OF THE INVENTION

The present subject matter relates generally to control knobs on an appliance, such as a cooking appliance.

BACKGROUND OF THE INVENTION

Knobs are commonly used on a variety of commercial and residential appliances to control an operating condition of the appliance. Knobs are particularly common on cooking appliances, such as stoves or cooktops. Various shapes and sizes can be used depending upon e.g., the intended application, aesthetics, and other factors.

As an example, cooking appliances that include a cooktop traditionally have at least one heating element positioned on a panel proximate a cooktop surface for use in heating or cooking an object, such as a cooking utensil, and its contents. The heating element can operate to heat a cooking utensil directly through induction heating, or may use another heat source such as electrically resistant coils or gas burners. Generally, a control knob may be fixed through a panel of the cooking appliance to engage a controller behind the panel, or otherwise within the cooking appliance.

Certain challenges exist with this construction, however. For instance, this construction typically requires one or more holes to be defined through the panel in order for the control knob to engage the controller. In turn, it is possible that solid or liquid food items may fall through the holes, potentially leading to damage of the controller or other internal components. Furthermore, these holes may make it difficult to clean the appliance, especially within the area beneath the panel.

Concerns may also arise with a knob assembly that is fixed to the cooking appliance. As an example, inadvertently striking the knob may cause a portion of the cooking appliance to break. As another example, the heating element may be accidentally activated, such as by a careless bystander or small child. Thus, in certain situations, it may be preferable to remove the control knob and/or prevent the heating element from being activated.

Accordingly, an improved control knob assembly would be beneficial. In particular, it may be advantageous to provide a control knob assembly that does not require a hole through a surface of an appliance (i.e., the surface on which a control knob is supported). Moreover, it may be advantageous to provide a control knob that can be easily removed from and remounted to an appliance without causing damage thereto.

BRIEF DESCRIPTION OF THE INVENTION

Aspects and advantages of the invention will be set forth in part in the following description, or may be obvious from the description, or may be learned through practice of the invention.

In one aspect of the present disclosure, a knob assembly is provided. The knob assembly may include a control panel, a control knob, an attractor plate, and an analog position sensor. The control panel may have a planar outer surface and an opposite inner surface. The control knob may be selectively disposed on the control panel at the planar outer surface. The control knob may include a knob body and a first magnetic assembly rotatable about a central axis extending perpendicular to the control panel. The attractor plate may be mounted behind the control panel about the central axis. The attractor plate may include a second magnetic assembly in selective magnetic engagement with the first magnetic assembly. The analog position sensor may be mounted to the attractor plate to detect an angular position of the attractor plate about the central axis.

In another aspect of the present disclosure, a cooking appliance is provided. The cooking appliance may include a cooktop surface, a heating element attached to the cooktop surface, and a knob assembly. The knob assembly may include a control panel, a control knob, an attractor plate, and an analog position sensor. The control panel may have a planar outer surface and an opposite inner surface. The control knob may be selectively disposed on the control panel at the planar outer surface. The control knob may include a knob body and a first magnetic assembly rotatable about a central axis extending perpendicular to the control panel. The attractor plate may be mounted behind the control panel about the central axis. The attractor plate may include a second magnetic assembly in selective magnetic engagement with the first magnetic assembly. The analog position sensor may be mounted to the attractor plate to detect an angular position of the attractor plate about the central axis.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
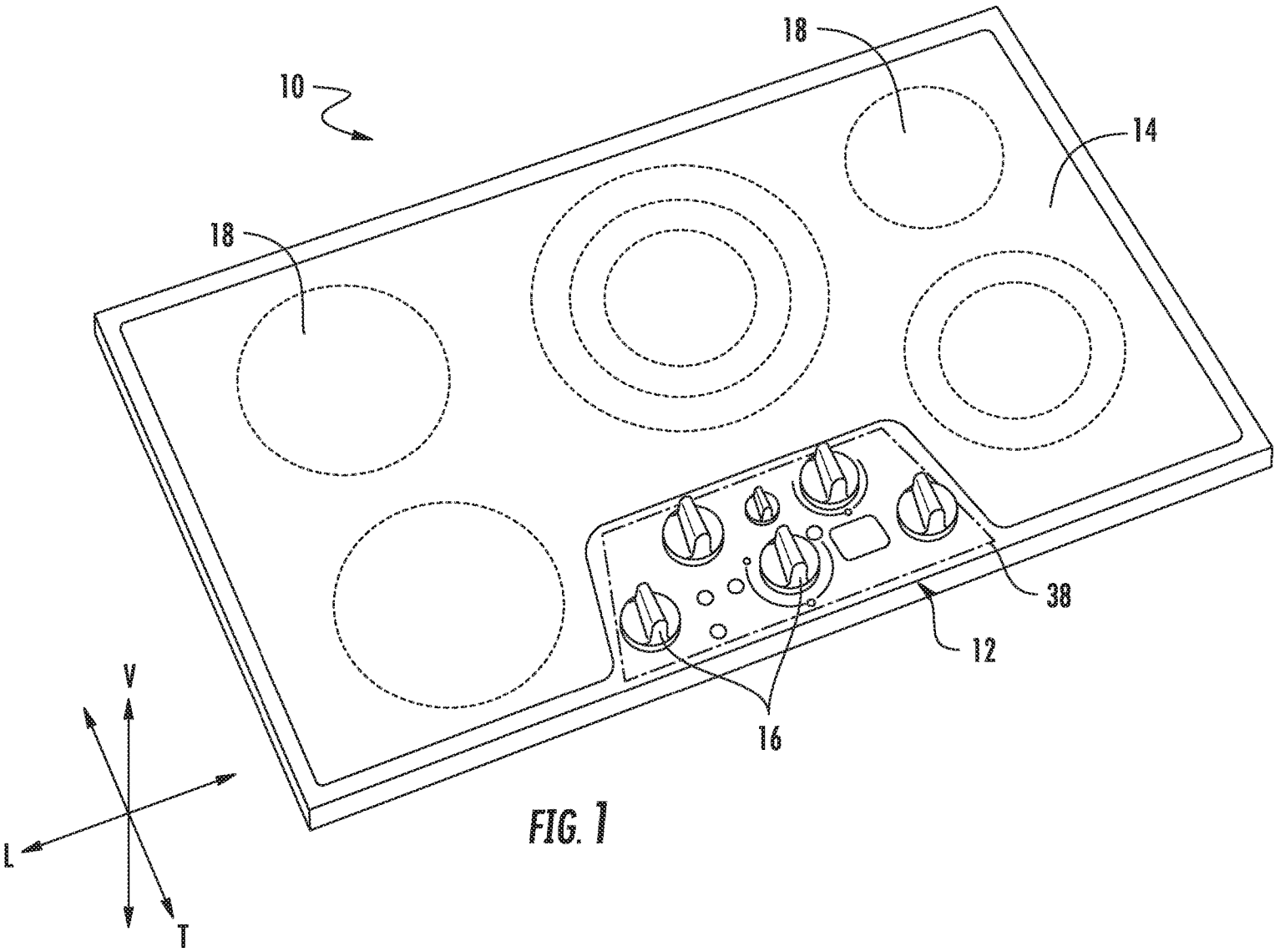
FIG. 1 provides a perspective view of a cooking appliance according to example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, some aspects of the present disclosure provide a control knob that is removably mounted on top of a control panel of an appliance. The control panel may be a substantially solid surface, free of any holes through which the control knob can be inserted. The control knob may rotate on the control panel to control operation of the appliance. A magnetic connection or coupling may form between the control knob and an analog position sensor. Thus, as the control knob rotates on top of the control panel, the analog position sensor may similarly rotate to track the position of the control knob and communicate that position to controller or other portion of the appliance.

Referring now to the figures, FIG. 1 illustrates an example embodiment of a cooking appliance 10, according to the present disclosure. Cooking appliance 10 generally defines a vertical direction V, a lateral direction L, and a transverse direction T. The vertical direction V, lateral direction L, and transverse direction T are each mutually perpendicular and form an orthogonal direction system.

Cooking appliance 10 may be, e.g., fitted integrally with a surface of a kitchen counter, or be a part of a range appliance. Cooking appliance 10 can include a chassis (not shown) and a cooktop surface 14 having one or more heating elements 18 for use in, e.g., heating or cooking operations. In one example embodiment, cooktop surface 14 is comprised of ceramic glass. In other embodiments, however, cooktop surface 14 may be comprised of another suitable material, such as a metallic material (e.g., steel) or another suitable non-metallic material. Heating elements 18 may be various sizes, as shown in FIG. 1, and may employ any suitable method for heating or cooking an object, such as a cooking utensil (not shown), and its contents. In one embodiment, for example, heating element 18 uses a heat transfer method, such as electric coils or gas burners, to heat the cooking utensil. In another embodiment, however, heating element 18 uses an induction heating method to heat the cooking utensil directly. In turn, heating element 18 may include a gas burner element, electric heat element, induction element, or another suitable heating element.

During use of cooking appliance 10, the amount of heat delivered by each heating element 18 on cooktop surface 14 is controlled by a controller 38 and control knob 16, as described in detail below. Optionally, each control knob 16 may correspond to a discrete heating element 18. Knob 16, as used herein, refers to any configuration of dial, and not just one having a circular base shape, as shown in FIG. 1. For example, the present disclosure contemplates example embodiments wherein knobs 16 have a rectangular base shape, an ovular base shape, or any other shape having one or more curved lines, straight lines, or both.

In turn, in some embodiments of cooking appliance 10, controller 38 may be configured to control one or more operations of cooking appliance 10. For example, controller 38 may control at least one operation of cooking appliance 10 that includes an internal heating element or cooktop heating element 18. Controller 38 may be in communication (via for example a suitable wired or wireless connection) with one or more of heating element(s) 18 and other suitable components of cooking appliance 10.

By way of example, controller 38 may include one or more memory devices and one or more microprocessors, such as general or special purpose microprocessors operable to execute programming instructions or micro-control code associated with an operating cycle. The memory devices or memory may represent random access memory such as DRAM, or read only memory such as ROM or FLASH. In one embodiment, the processor executes programming instructions stored in memory. The memory may be a separate component from the processor or may be included onboard within the processor.

Controller 38 may be positioned in a variety of locations throughout cooking appliance 10. As illustrated, controller 38 may be located within cooking appliance 10, e.g., beneath cooktop surface 14. In some such embodiments, input/output ("I/O") signals may be routed between controller 38 and various operational components of cooking appliance 10, such as heating element(s) 18, control knobs 16, display components, sensors, alarms, and/or other components as may be provided. For instance, signals may be directed along one or more wiring harnesses that may be routed through appliance 10. In some embodiments, controller 38 is in communication with knob assembly 12 and control knobs 16 through which a user may select various operational features and modes and monitor progress of cooking appliance 10.

Turning to FIGS. 2 through 7, an example knob assembly 12 is illustrated. In some embodiments, knob assembly 12 includes a flat control panel 22 that is substantially solid or free of any holes through which a portion of a control knob or water may pass. Control panel 22, as used herein, refers to any surface of cooking appliance 10, such as cooktop surface 14 (FIG. 1). For example, the present disclosure contemplates example embodiments where the entirety of cooktop surface 14 is comprised of a single suitable material. The present disclosure also contemplates other embodiments where cooktop surface 14 is comprised of one material proximate to heating elements 18 (e.g., metal), and control panel 22 is comprised of another material that is non-magnetic and/or non-metallic (e.g., plastic, glass, glass ceramic, etc.) proximate to control knob(s) 16. Control panel 22 may extend perpendicular to vertical direction V, as shown, or at another suitable angle relative thereto.

Generally, control panel 22 provides two opposing surfaces. Specifically, control panel 22 includes an outer surface 24 and an inner surface 26. As shown, outer surface 24 may be substantially planar and extend along a constant angle, e.g., horizontally. Although it is understood that control panel 22 may be disposed at any suitable orientation, when mounted horizontally (similar to the embodiment of FIG. 1), outer surface 24 is generally directed (i.e., faces) upward along the vertical direction V while inner surface 26 is generally directed downward along the vertical direction V. Indicator graphics may be provided (e.g., printed or embedded) on control panel (e.g., at outer surface 24) to indicate the relationship between the angular or rotational position of control knob 16 and output at a corresponding heating element 18 (FIG. 1). Alternatively, one or more display lights (not pictured) may be provide to illuminate in accordance with the angular or rotational position of control knob 16.

Figure 3:
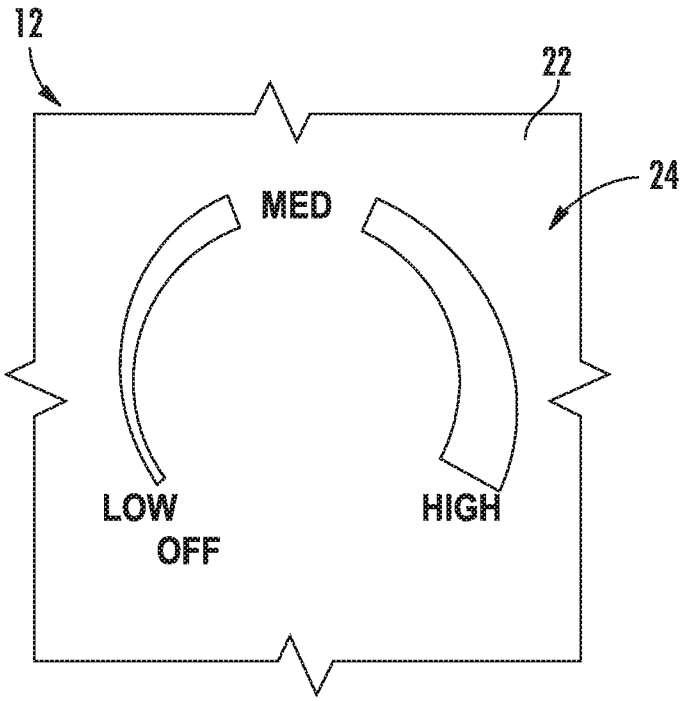
FIG. 3 provides a top view of the example control panel of FIG. 2, wherein the control knob is in an unmounted position relative to the control panel.
Figure 2:
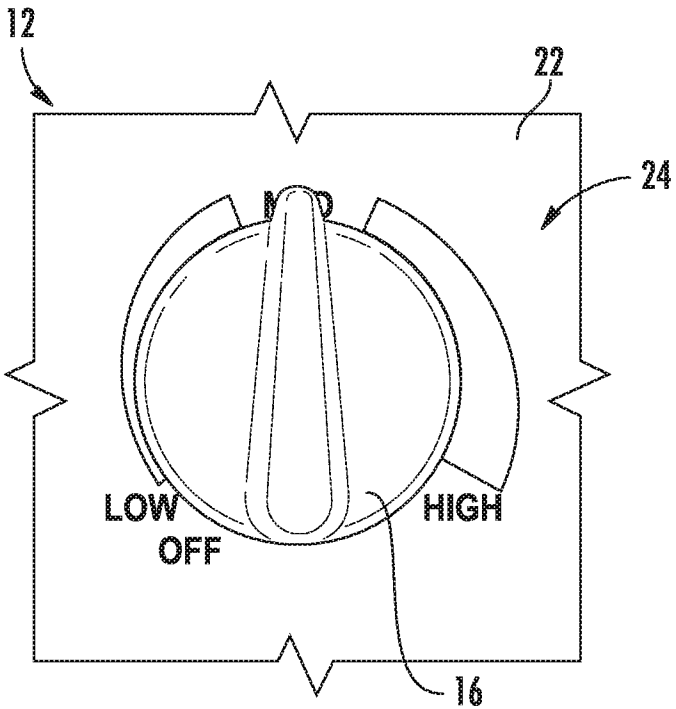
FIG. 2 provides a top view of a knob assembly according to example embodiments of the present disclosure, wherein the control knob is in a mounted position on a control panel.
Figure 4:
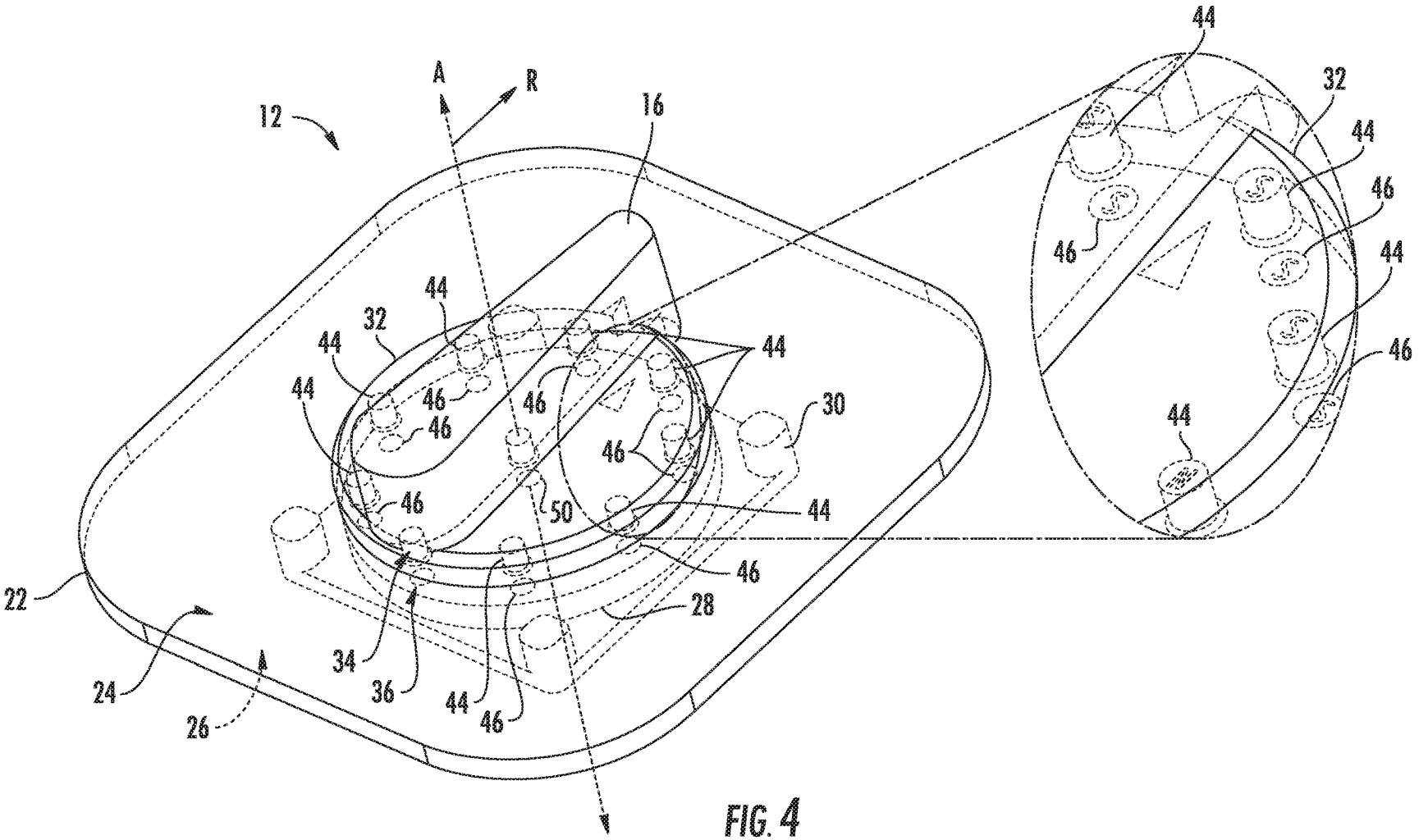
FIG. 4 provides a perspective view of a knob assembly according to example embodiments of the present disclosure.

Control knob 16 may be selectively (i.e., removably) disposed on control panel 22 to assume a mounted position, as shown in FIG. 2. Conversely, control knob 16 may be removed or unmounted from control panel 22 in an unmounted position, as shown in FIG. 3. In the mounted position, control knob 16 is generally positioned on or at outer surface 24, e.g., in contact therewith. Thus, control knob 16 is disposed closer to outer surface 24 than inner surface 26. In turn, at least a portion of control knob 16 may engage or contact planar outer surface 24. In the mounted position, control knob 16 is rotatable about a central axis A. During operations, control knob 16 may thus rotate along or above control panel 22. In embodiments wherein control panel 22 extends horizontally (similar to the embodiment of FIG. 1), central axis A may be parallel to the vertical direction V. Moreover, control panel 22, e.g., planar outer surface 24, may extend perpendicular to the central axis A.

In the mounted position, control knob 16 is disposed above or forward from control panel 22 along the central axis A. As shown, control knob 16 does not extend into or through control panel 22. When assembled, control panel 22 may be a substantially solid surface, at least within a footprint defined by control knob 16 in the mounted position. Advantageously, control panel 22 may thus prevent spilled liquids or food items from passing therethrough. Moreover, control panel 22 may be easily cleaned, e.g., when control knob 16 is unmounted and removed therefrom.

One or both of an attractor plate 28 and an analog position sensor 40 may be mounted below or behind control panel 22 e.g., at the inner surface 26 within the footprint of control knob 16. Thus, attractor plate 28 and analog position sensor 40 may be disposed opposite control knob 16. Although control panel 22 extends between control knob 16 and attractor plate 28/analog position sensor 40, attractor plate 28 and analog position sensor 40 may be operably engaged with control knob 16 in the mounted position, as will be described in greater detail below.

In the mounted position, a magnetically-coupled pair selectively couples control knob 16 and attractor plate 28. The pair may include at least a first magnetic assembly 34 and a second magnetic assembly 36. Generally, first magnetic assembly 34 and second magnetic assembly 36 are attracted to each other by a magnetic field generated by the pair. First magnetic assembly 34 is included within the knob body 32 of control knob 16. Second magnetic assembly 36 is included within attractor plate 28. As shown, attractor plate 28, including second assembly 36, may be supported within a compartment 42 defined by a retainer bracket 30. Retainer bracket 30 may be joined to control panel 22, e.g., by one or more adhesive or mechanical connector.

Both first magnetic assembly 34 and second magnetic assembly 36 include at least one magnetic element, e.g., radial magnetic elements 44, 46 and central magnetic elements 48, 50). These magnetic elements may be formed from any material that is suitably responsive to a magnetic field and/or capable of generating a magnetic field. In other words, the magnetic elements (e.g., radial magnetic elements 44, 46 and central magnetic elements 48, 50) are not formed from a purely diamagnetic material. For instance, the magnetic elements may be permanent magnet, ferromagnetic element, or electromagnetic element.

First magnetic assembly 34 and second magnetic assembly 36 may be generally formed to mirror or compliment the other in the mounted position. When control knob 16 is in the mounted position, radial magnetic elements 44, 46 of first magnetic assembly 34 and second magnetic assembly 36 are magnetically engaged or coupled to rotate about central axis A. At least one radial magnetic element 44 of the first magnetic assembly 34 is aligned with a radial magnetic element 46 of the second magnetic assembly 36 radially outward from the central axis A. By contrast, removing control knob 16 from control panel 22 (e.g., to the unmounted position) may break the magnetic engagement and allow control knob 16 to move freely with respect to control panel 22 while the at least one magnetic element 46 of the second magnetic assembly 36 remains radially outward from the central axis A.

One or both of first magnetic assembly 34 and second magnetic assembly 36 may include a plurality of radial magnetic elements 44, 46. As shown in the example embodiments of FIGS. 4 through 7, some embodiments of first magnetic assembly 34 include a plurality of magnetic elements 44 formed as slugs along a circumferential direction C about central axis A, e.g., in the mounted position. Each magnetic element 44 of first magnetic assembly 34 may be disposed at a discrete angular position within knob body 32, e.g., within a common plane. In other words, each radial magnetic element 44 may be disposed at a unique angle relative to the central axis A. Alternatively, first magnetic assembly 34 may include a singular magnetic element, such as a ring formed about central axis A.

As shown, second magnetic assembly 36 may be generally matched to first magnetic assembly 34 and/or parallel thereto. In turn, second magnetic assembly 36 may include a plurality of magnetic elements 46 formed as slugs along a circumferential direction C about central axis A. Each magnetic element 46 of second magnetic assembly 36 may correspond to a discrete magnetic element 44 of first magnetic assembly 34. Additionally or alternatively, second magnetic assembly 36 may include a singular magnetic element, such as a ring formed about central axis A.

In some embodiments, the first magnetic assembly 34 may include a plurality of permanent magnets disposed at discrete angular positions within knob body 32 while the second magnetic assembly 36 comprises a ferromagnetic material to selectively engage the plurality of permanent magnets of the first magnetic assembly 34. In other embodiments, first magnetic assembly 34 comprises a ferromagnetic material while second magnetic assembly 36 comprises a plurality of permanent magnets disposed at discrete angular positions about the central axis A to selectively engage the ferromagnetic material of the first magnetic assembly 34.

As shown, a central magnetic element 48, 50 of first magnetic assembly 34 may be disposed within knob body 32 to selectively engage a corresponding central magnetic element 48, 50 of second magnetic assembly 36. Thus, when control knob 16 is in the mounted position, the central magnetic elements 48, 50 may be coaxially disposed in parallel along the central axis A.

In optional embodiments, first magnetic assembly 34 and second magnetic assembly 36 maintain a predefined mounting orientation. For instance, first magnetic assembly 34 may include a plurality of radial magnetic elements 44 disposed at discrete angular positions within knob body 32 while second magnetic assembly 36 comprises a plurality of radial magnetic element 46 corresponding to the plurality of radial magnetic elements 44 of the first magnetic assembly 34. Each magnetic element 46 of the second magnetic assembly 36 may be disposed at a discrete angular position about the central axis A to selectively engage the corresponding magnetic element 44 of the first magnetic assembly 34. As a result, the magnetic engagement between first magnetic assembly 34 and second magnetic assembly 36 may ensure a consistent relative orientation of control knob 16 to attractor plate 28 and/or analog position sensor 40.

Figure 5:
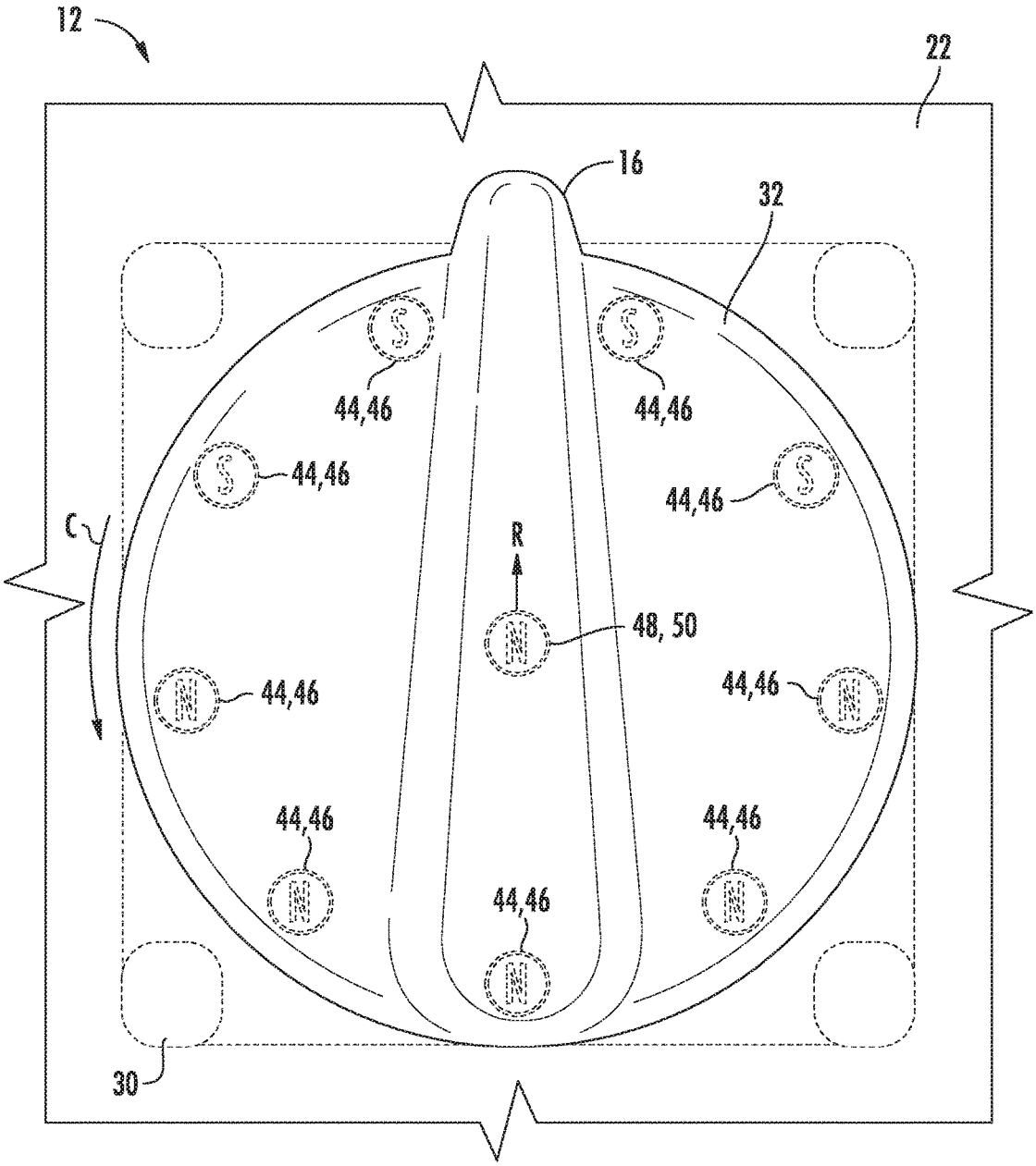
FIG. 5 provides a top view of the example knob assembly of FIG. 4.
Figure 6:
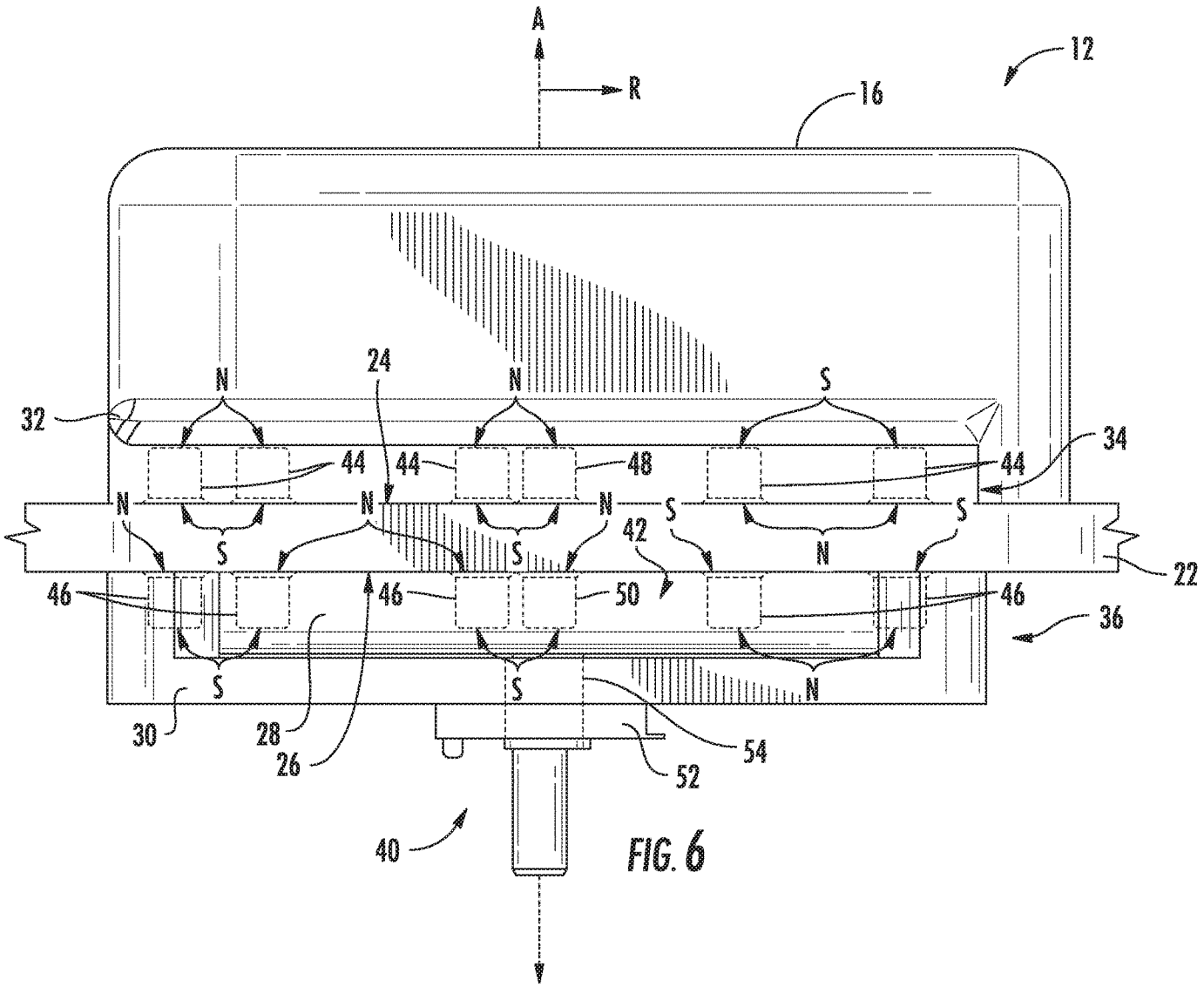
FIG. 6 provides a side view of the example knob assembly of FIG. 4.

In additional or alternative embodiments, the polarity or pole direction of magnetic elements 44, 46 may further establish the predetermined mounting orientation. As illustrated in FIGS. 5 and 6, magnetic elements 44 of first magnetic assembly 34 may have opposing north (N) and south (S) poles. The north pole (N) of one or more of the radial magnetic elements 44 of first magnetic assembly 34 are directed toward the control panel 22 (e.g., downward along the central axis A) while the south pole (S) of one or more other radial magnetic elements 44 of first magnetic assembly 34 are directed toward control panel 22. Radial magnets 46 of the second magnetic assembly 36 may be disposed in a complementary mirrored formation. In other words, the north pole (N) of one or more of the radial magnetic elements 46 of second magnetic assembly 36 are directed toward the control panel 22 (e.g., upward along the central axis A) while the south pole (S) of one or more other radial magnetic elements 46 of second magnetic assembly 36 are directed toward control panel 22. Advantageously, the predefined mounting orientation and polarity of magnetic elements 44, 46 may ensure proper rotational alignment of control knob 16 relative to attractor plate 28 and/or analog position sensor 40.

Figure 7:
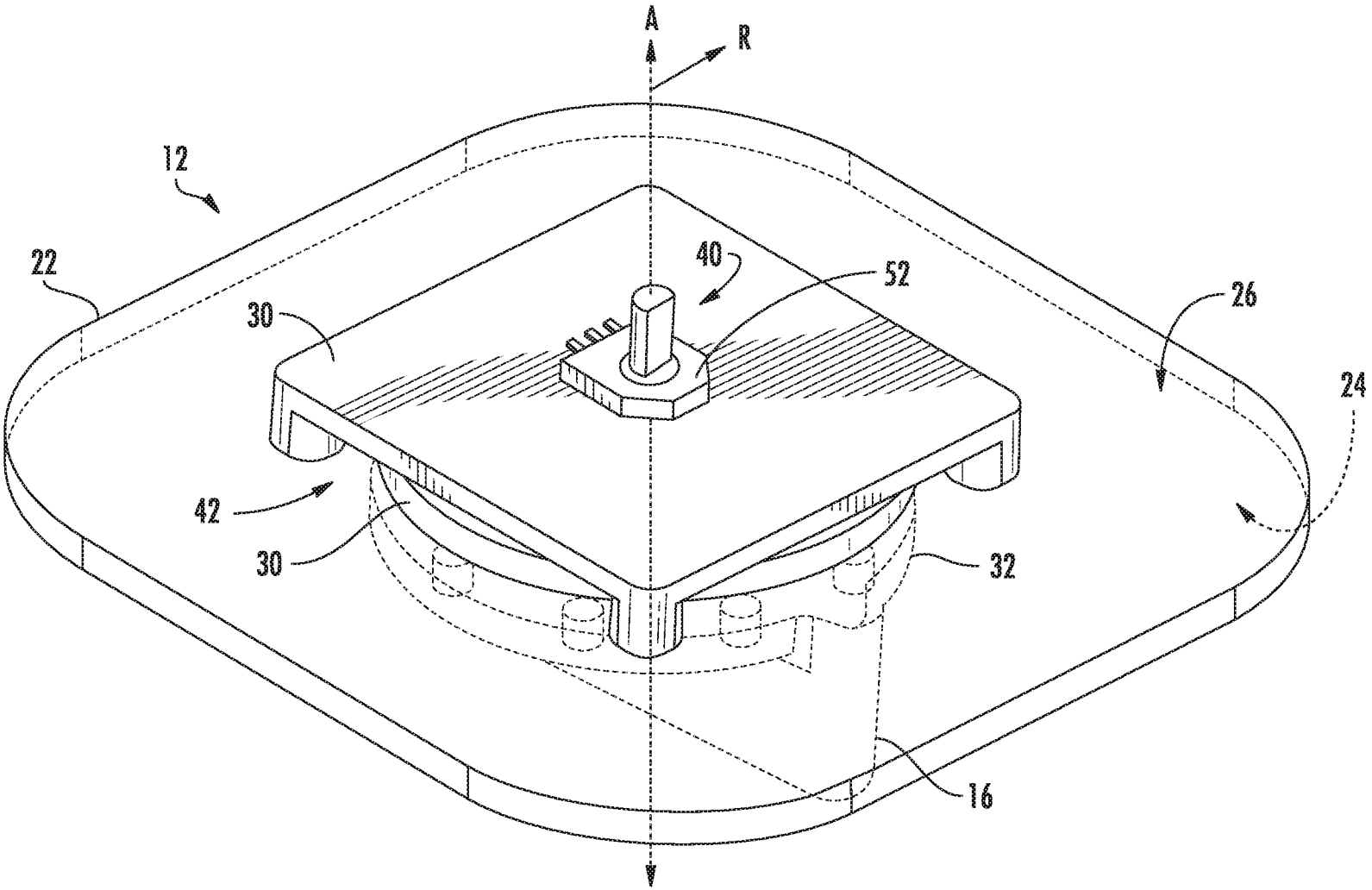
FIG. 7 provides a bottom perspective view of the example knob assembly of FIG. 4.

As shown in FIGS. 6 and 7, analog position sensor 40 is rotationally attached to attractor plate 28. During operations, angular position sensor 40 may thus detect the overall angular or rotational position of attractor plate 28 about the central axis A, e.g., relative to an initial or preset rotational position. As attractor plate 28 rotates, at least a portion of analog position sensor 40 may similarly rotate.

In some embodiments, analog position sensor 40 includes a potentiometer 52 that has a rotatable input stem 54 extending to attractor plate 28. When assembled, rotatable input stem 54 may be fixed to attractor plate 28. Moreover, input stem 54 may be attached to potentiometer 52 such that a portion of input stem 54 rotates therein. Potentiometer 52 is generally understood to act a variable resistor. A voltage through potentiometer 52, e.g., to be delivered to heating element 18 (FIG. 1), may be determined by the position of input stem 54. During use, rotation of control knob 16, and thereby attractor plate 28 and input stem 54, may thus alternately increase or decrease voltage through potentiometer 52. In turn, rotation of rotation of control knob 16 and input stem 54 may alternately increase or decrease an output of heating element 18. In some such embodiments, potentiometer 52 may operably connect to controller 38 (FIG. 1). The variable voltage may be received at controller 38, e.g., as a position signal to be subsequently communicated to heating element 18 and/or another portion of appliance 10 (FIG. 1).

Figure 8:
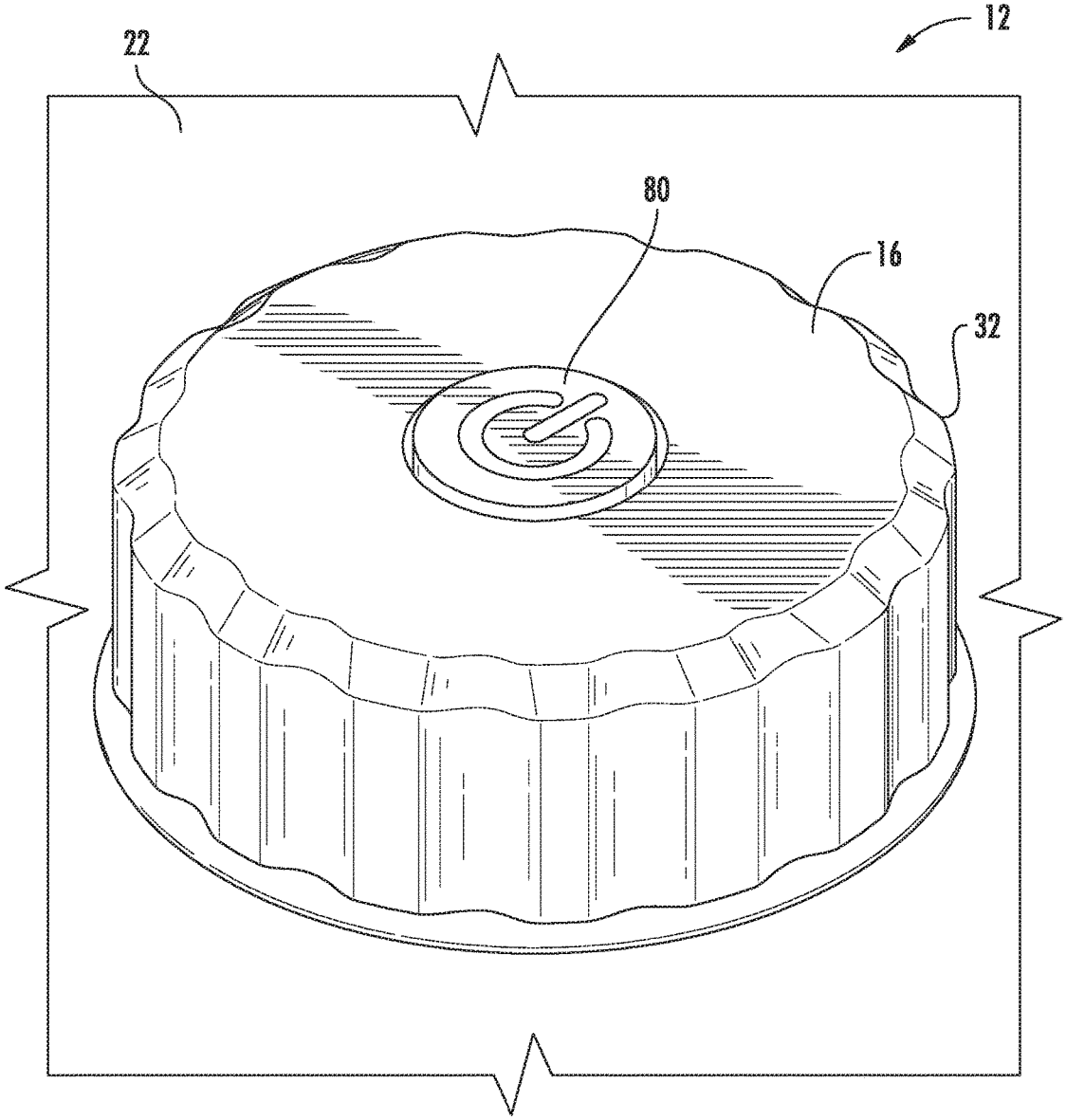
FIG. 8 provides a perspective view of a knob assembly according to example embodiments of the present disclosure.
Figure 9:
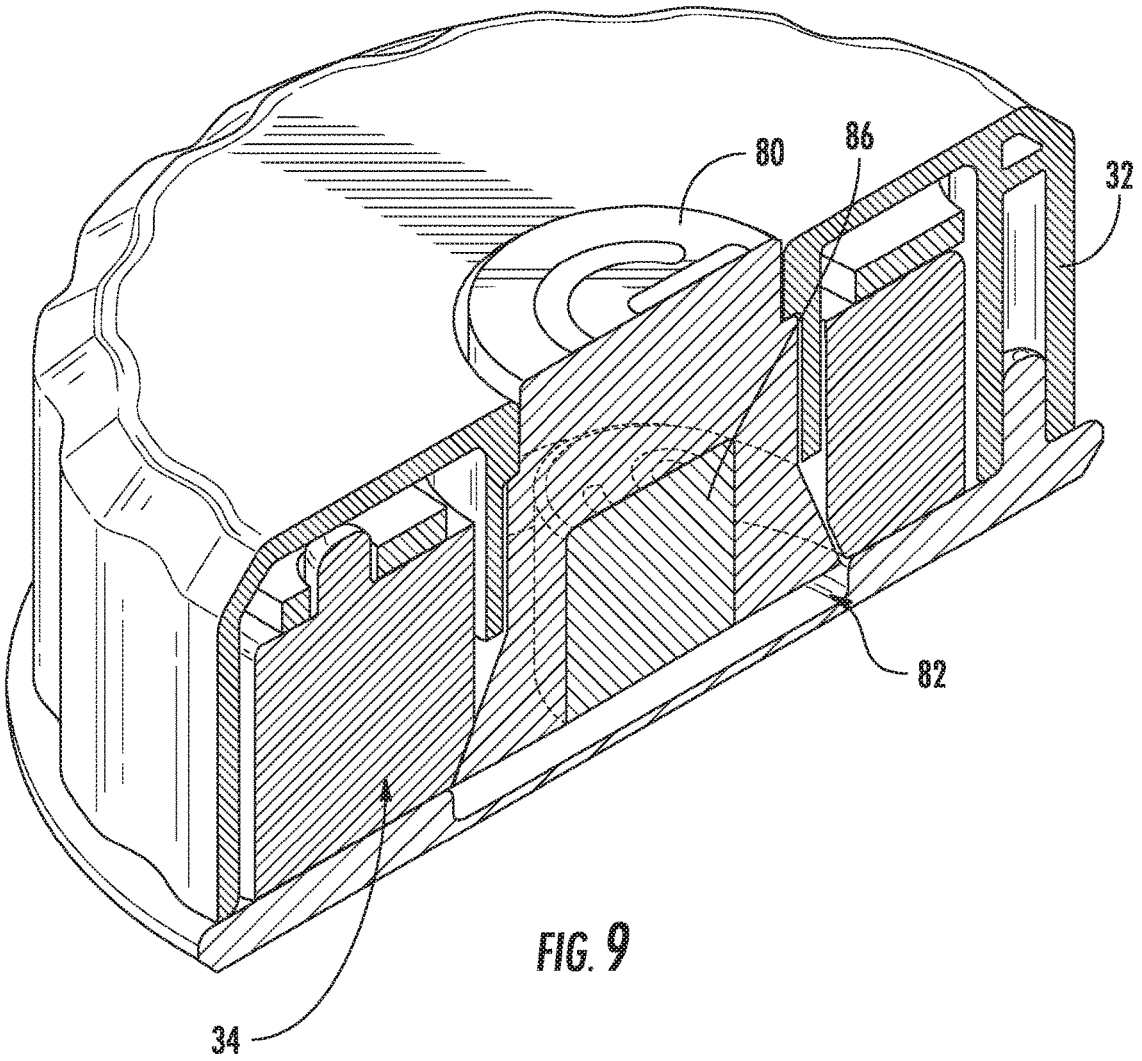
FIG. 9 provides a cross-sectional perspective view of the example control knob of FIG. 8.
Figure 10:
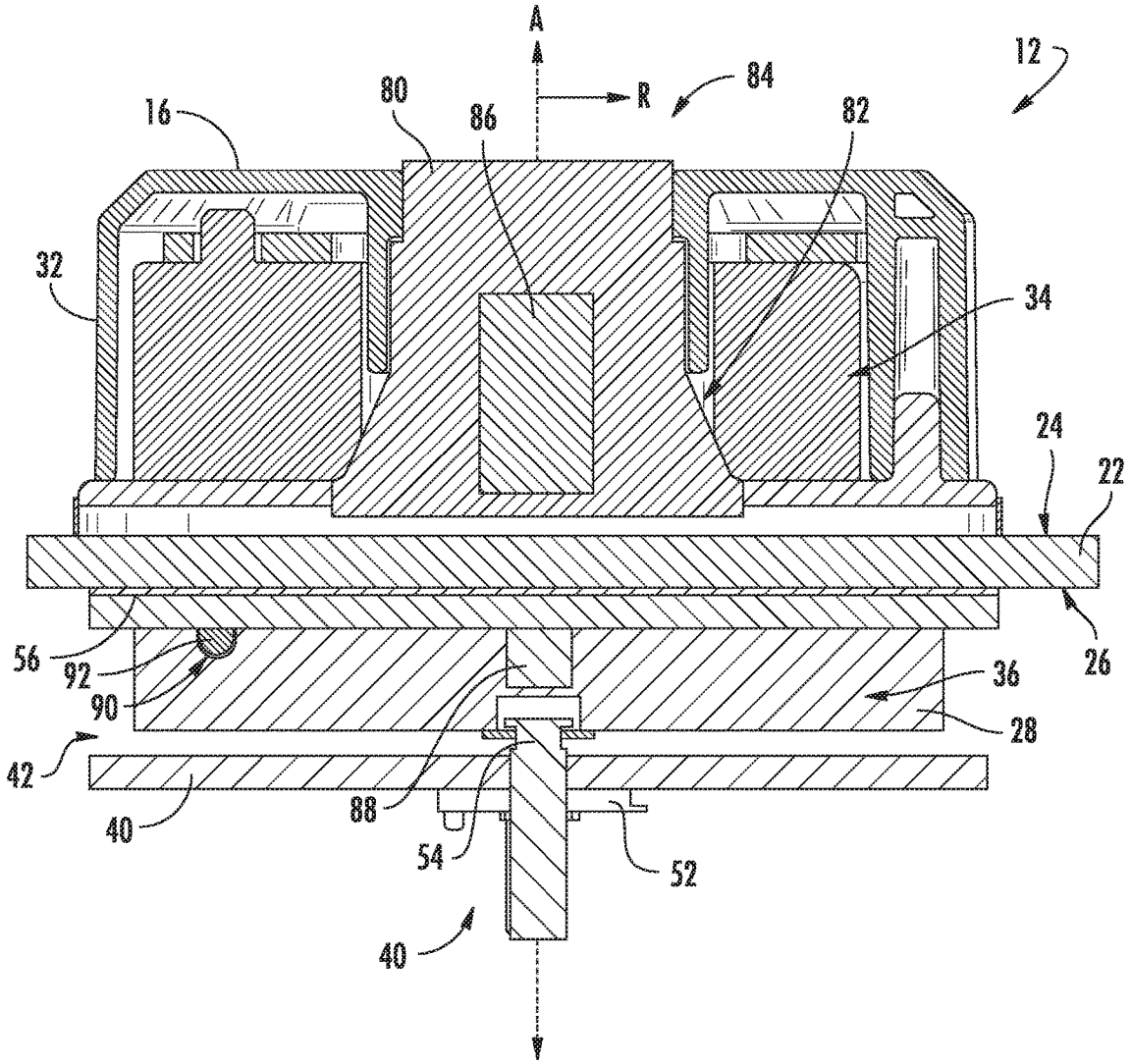
FIG. 10 provides a cross-sectional side view of the example knob assembly of FIG. 8.

Turning now to FIGS. 8 through 10, additional embodiments of knob assembly 12 are illustrated. It is understood that that knob assembly 12 of FIGS. 8 through 10 may include each feature of the above-described embodiments. Similarly, any of the features described with respect to the embodiments of FIGS. 8 through 10 may be used or incorporated into the embodiments of FIGS. 1 through 7, except as otherwise indicated.

As shown in FIGS. 8 through 10, some embodiments of control knob 16 include a slidable member 80 supported on or within knob body 32. For instance, slidable member 80 may be received within a central cavity 82 defined by knob body 32, e.g., coaxial with central axis A. When control knob 16 is in the mounted position, knob body 32 may engage or contact control panel 22, as described above. Slidable member 80 may act under push-button engagement, e.g., as motivated by user. Thus, during use, slidable member 80 may slide axially (e.g., along central axis A) within central cavity 82 to selectively contact control panel 22.

In certain embodiments, a repelling assembly 84 is provided to bias slidable member 80 away from control panel 22. In some such embodiments, a first repelling magnet 86 is mounted within slidable member 80 in a first pole direction. A second repelling magnet 88 is mounted behind control panel 22 (e.g., on attractor plate 28) in a second pole direction. In the mounted position, first repelling magnet 86 and second repelling magnet 88 may be coaxial, e.g., about the central axis A. As shown, the second pole direction is opposite from first pole direction. In other words, the north-south poles of first repelling magnet 86 are oriented to act against the north-south poles of second repelling magnet 88. As an example, the north pole (N) of first repelling magnet 86 may be directed toward control panel 22 (e.g., downward along the central axis A) while the north pole (N) of second repelling magnet 88 is also directed toward control panel 22 (e.g., upward along the central axis A). In turn, an external force, such as an input force provided by a user, may be required to overcome the biasing force of the opposing repelling magnets 86, 88 and bring slidable member 80 into contact or engagement with control panel 22, e.g., at the outer surface 24.

In some embodiments, a presence sensor 56 is mounted behind control panel 24 to detect control knob 16 in the mounted position. During operations, the presence sensor 56 may thus determine whether control knob 16 is disposed on control panel 24 in the mounted position. For instance, detection signal may be transmitted by presence sensor 56 to controller 38 upon detection of control knob 16. In turn, controller 38 may be configured to require reception of detection signal before or during activation heating element 18 (FIG. 1). Advantageously, heating element 18 may be instantly deactivated or prevented from activating when control knob 16 is not mounted to control panel 22.

In some such embodiments, presence sensor is a capacitive detection panel 56 mounted between control panel 22 and attractor plate 28, as shown in FIG. 10. During use, capacitive detection panel 56 may detect magnetic engagement between the first magnetic assembly 34 and the second magnetic assembly 36 (e.g., when control knob 16 is in the mounted position). Accordingly, as control knob 16 is placed in the mounted position, capacitive detection panel 56 may detect the variation in capacitance caused by the increased magnetic field strength. The detected variation may be communicated as a detection signal, e.g., received by controller 38.

In additional or alternative embodiments, capacitive detection panel 56 may be mounted between the first repelling magnet 86 and second repelling magnet 88. When assembled, presence detection panel 56 may detect the variation in capacitance caused by the engagement of slidable member 80 with control panel 22. The detected variation may be communicated as a detection signal, e.g., received by controller 38 to activate heating element 18 (FIG. 1).

Optionally, attractor plate 28, including second magnetic assembly 36 may slide along central axis A, e.g., in slidable attachment to retainer bracket 30 and/or input stem 54. Compartment 42 may have a height greater than that of attractor plate 28. Thus, attractor plate 28 may be generally able to slide along central axis A within compartment 42. Gravity, or another biasing force, may generally motivate attractor plate 28 downward away from control panel 22. In turn, the presence of control knob 16, including first magnetic assembly 34, in the mounted position may draw attractor plate 28 upward toward control panel 22, generating a variation in capacitance to be detected at capacitive panel 56.

In alternative embodiments, the presence sensor 56 may be one or more other suitable sensors for determining that control knob 16 is in the mounted position. For instance, the presence sensor may be provided as an optical sensor transmitting a light beam through control panel 22. A reflective surface may be provided on a bottom portion of control knob 16 and thereby reflect the transmitted light beam. The reflected light beam may be received at the optical sensor and subsequently transmit a responsive detection signal, e.g., to controller 38.

In further additional or alternative embodiments, a set of detents 90 and matching prongs 92 may be formed, e.g., between attractor plate 28 and control panel 22. The detents 90 and/or prongs 92 may be arranged at multiple discrete locations about central axis A. The prongs 92 may be received by the detents 90 when the pair is rotationally or circumferentially aligned. In turn, rotation of attractor plate 28 (as caused by rotation of control knob 16) may cause deflection of attractor plate 28, e.g., axially, and provide a tactile feedback or click to a user during rotation of control knob 16.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A knob assembly for an appliance, the knob assembly comprising:

a control panel having a planar outer surface and an opposite inner surface;

a control knob selectively disposed on the control panel at the planar outer surface, the control knob comprising a knob body and a first magnetic assembly rotatable about a central axis extending perpendicular to the control panel;

an attractor plate mounted behind the control panel about the central axis, the attractor plate comprising a second magnetic assembly in selective fixed magnetic engagement to rotate with the first magnetic assembly; and an analog position sensor mounted in rotational attachment to rotate in tandem with the attractor plate to detect an angular position of the attractor plate about the central axis.

2. The knob assembly of claim 1, wherein the second magnetic assembly comprises a radial magnetic element disposed radially outward from the central axis.

3. The knob assembly of claim 1, wherein the first magnetic assembly comprises a central magnetic element disposed within the knob body, and wherein the second magnetic assembly comprises a central magnetic element disposed along the central axis to selectively engage the central magnetic element of the first magnetic assembly.

4. The knob assembly of claim 1, wherein the first magnetic assembly comprises a plurality of radial magnetic elements disposed at discrete angular positions within the knob body, and wherein the second magnetic assembly comprises a plurality of radial magnetic elements corresponding to the plurality of radial magnetic elements of the first magnetic assembly, and wherein the magnetic elements of the second magnetic assembly are disposed at discrete angular positions about the central axis to selectively engage the corresponding magnetic elements of the first magnetic assembly.

5. The knob assembly of claim 4, wherein a north pole of a radial magnetic element of the second magnetic assembly is directed toward the control panel, wherein a south pole of another radial magnetic element of the second magnetic assembly is directed toward the control panel, and wherein the pole directions of the second magnetic assembly define a mounting orientation for the control knob.

6. The knob assembly of claim 1, wherein the analog position sensor comprises a potentiometer, the potentiometer comprising a rotatable stem fixed to the attractor plate.

7. The knob assembly of claim 1, further comprising a retainer bracket attached to the control panel at the inner surface, wherein the attractor plate is rotatably supported within a compartment defined by the retainer bracket.

8. The knob assembly of claim 1, further comprising a presence sensor mounted behind the control panel to detect the control knob in a mounted position on the control panel.

9. The knob assembly of claim 1, wherein the first magnetic assembly comprises a plurality of permanent magnets disposed at discrete angular positions within the knob body, wherein the second magnetic assembly comprises a ferromagnetic material to selectively engage the plurality of permanent magnets of the first magnetic assembly, or a ferromagnetic material, wherein the second magnetic assembly comprises a plurality of permanent magnets disposed at discrete angular positions about the central axis to selectively engage the ferromagnetic material of the first magnetic assembly.

10. The knob assembly of claim 1, wherein the attractor plate is slidably attached to the analog position sensor to selectively slide along the central axis in response to magnetic engagement with the first magnetic assembly.

11. A cooking appliance, comprising:

a cooktop surface;

a heating element attached to the cooktop surface; and a knob assembly, comprising a control panel having a planar outer surface and an opposite inner surface, a control knob selectively disposed on the control panel at the planar outer surface, the control knob comprising a knob body and a first magnetic assembly rotatable about a central axis extending perpendicular to the control panel, an attractor plate mounted behind the control panel about the central axis, the attractor plate comprising a second magnetic assembly in selective fixed magnetic engagement to rotate with the first magnetic assembly, and an analog position sensor mounted in rotational attachment to rotate in tandem with the attractor plate to detect an angular position of the attractor plate about the central axis.

12. The cooking appliance of claim 11, wherein the second magnetic assembly comprises a radial magnetic element disposed radially outward from the central axis.

13. The cooking appliance of claim 11, wherein the first magnetic assembly comprises a central magnetic element disposed within the knob body, and wherein the second magnetic assembly comprises a central magnetic element disposed along the central axis to selectively engage the central magnetic element of the first magnetic assembly.

14. The cooking appliance of claim 11, wherein the first magnetic assembly comprises a plurality of radial magnetic elements disposed at discrete angular positions within the knob body, and wherein the second magnetic assembly comprises a plurality of radial magnetic elements corresponding to the plurality of radial magnetic elements of the first magnetic assembly, and wherein the magnetic elements of the second magnetic assembly are disposed at discrete angular positions about the central axis to selectively engage the corresponding radial magnetic elements of the first magnetic assembly.

15. The cooking appliance of claim 14, wherein a north pole of a radial magnetic element of the second magnetic assembly is directed toward the control panel, wherein a south pole of another radial magnetic element of the second magnetic assembly is directed toward the control panel, and wherein the pole directions of the second magnetic assembly define a mounting orientation for the control knob.

16. The cooking appliance of claim 11, wherein the analog position sensor comprises a potentiometer, the potentiometer comprising a rotatable stem fixed to the attractor plate.

17. The cooking appliance of claim 11, further comprising a retainer bracket attached to the control panel at the inner surface, wherein the attractor plate is rotatably supported within a compartment defined by the retainer bracket.

18. The cooking appliance of claim 11, further comprising a presence sensor mounted behind the control panel to detect the control knob in a mounted position on the control panel.

19. The cooking appliance of claim 11, wherein the first magnetic assembly comprises a plurality of permanent magnets disposed at discrete angular positions within the knob body, wherein the second magnetic assembly comprises a ferromagnetic material to selectively engage the plurality of permanent magnets of the first magnetic assembly, or a ferromagnetic material, wherein the second magnetic assembly comprises a plurality of permanent magnets disposed at discrete angular positions about the central axis to selectively engage the ferromagnetic material of the first magnetic assembly.

20. The cooking appliance of claim 11, wherein the attractor plate is slidably attached to the analog position sensor to selectively slide along the central axis in response to magnetic engagement with the first magnetic assembly.

* * * * *